United States Patent [19]

Gohausen et al.

[11] 4,121,980

[45] Oct. 24, 1978

[54] METHOD OF SEALING OXIDIZED ALUMINUM SURFACES WITH AQUEOUS SOLUTIONS OF POLYCARBOXYLIC ACIDS

[75] Inventors: Hans Jürgen Göhausen, Hilden; Winfried Kirchhoff, Düsseldorf; Jürgen Lindener, Monheim, all of Germany

[73] Assignee: Henkel Kommanditgesellschaft auf Aktien (Henkel KGaA), Düsseldorf-Holthausen, Germany

[21] Appl. No.: 847,773

[22] Filed: Nov. 2, 1977

[30] Foreign Application Priority Data

Nov. 8, 1976 [DE] Fed. Rep. of Germany ..... 2650989

[51] Int. Cl.[2] ..... C25D 11/24

[52] U.S. Cl. ..... 204/35 N

[58] Field of Search ..... 204/35 N; 427/419 A, 427/419 D; 428/640, 654

[56] References Cited

U.S. PATENT DOCUMENTS

| | | | |
|---|---|---|---|
| 3,012,917 | 12/1961 | Riou et al. | 204/35 N |
| 3,440,150 | 4/1969 | Kramer et al. | 204/35 N |
| 3,838,023 | 9/1974 | Friedemann et al. | 204/35 N |

*Primary Examiner*—John H. Mack
*Assistant Examiner*—William Leader
*Attorney, Agent, or Firm*—Hammond & Littell

[57] ABSTRACT

In the process of treating an aluminum or aluminum alloy surface which comprises anodically oxidizing the surface and subsequently sealing the surface, the improvement consisting of sealing in an aqueous solution at a temperature between 90° C and the boiling temperature of the solution, said aqueous solution having a pH value of from 4 to 8 and containing from 0.0005 to 0.2 gm per liter of cycloaliphatic or aromatic polycarboxylic acid or water-soluble salt thereof, said cycloaliphatic or aromatic polycarboxylic acid having 4 to 6 carboxyl groups.

11 Claims, No Drawings

METHOD OF SEALING OXIDIZED ALUMINUM SURFACES WITH AQUEOUS SOLUTIONS OF POLYCARBOXYLIC ACIDS

FIELD OF THE INVENTION

The present invention relates to a method of treating the surfaces of aluminum or aluminum alloys by the anodic production of oxide coatings with subsequent sealing in aqueous solutions of cycloaliphatic or aromatic polycarboxylic acids or water-soluble salts thereof at increased temperatures, wherein the occurrence of troublesome aluminum hydroxide layers (sealing layers) on the surfaces is prevented.

BACKGROUND OF THE INVENTION

Anodically produced oxide coatings are frequently applied to aluminum surfaces for the purpose of protection against corrosion. These oxide coatings protect the aluminum surfaces against the influences of weather and other corrosive media. Furthermore, the anodic oxide coatings are also applied in order to obtain a harder surface and thus to increase the wear resistance of the aluminum. A special benefit from these oxide coatings lies in the decorative effects which may be obtained by virtue of the inherent color of the oxide coatings or by virtue of the fact that, in some cases, they can be readily colored.

A number of methods of applying anodic oxide coatings to aluminum are known. By way of example, the oxide coatings can be produced by direct current in solutions of sulphuric acid (direct current/sulphuric acid method). These coatings can be subsequently colored by immersion in solutions of a suitable dye or by treatment with alternating current in an electrolyte containing metallic salts. However, solutions of organic acids, particularly sulphophthalic acid or sulphanilic acid or, alternatively, these acids mixed with sulphuric acid, are also frequently used for the purpose of applying the oxide coatings. The last-mentioned methods are known as color anodization methods.

However, these anodically applied oxide coatings do not fulfil all requirements with respect to protection against corrosion, since they have a porous structure. For this reason, it is necessary to after-seal the oxide coatings. This after-sealing is frequently accomplished by means of hot or boiling water. The pores are thereby closed and thus the anti-corrosive effect is considerably increased.

However, in addition to closing the pores, the after-sealing of anodically applied oxide coatings also results in the formation of a more or less thick velvety layer, the so-called sealing layer, on the entire surface. This sealing layer comprises hydrated aluminum oxide and is not resistant to handling, thus adversly affecting the decorative effect of the coating. Furthermore, this sealing layer reduces the adhesive strength when aluminum members having such a layer are glued together and this layer promotes subsequent soiling and corrosion as a result of its enlarged effective surface. For these reasons, it was previously necessary to mechanically remove the layer by hand or by chemical methods.

It is already known to remove this sealing layer from sealed surfaces by after-treatment with mineral acid. In this method, a further treatment step is therefore necessary and, moreover, very careful after-treatment with mineral acid is required in order to prevent damage to the coating. Furthermore, in order to avoid sealing layers, the prior art includes after-sealing with solutions containing nickel acetate and lignin sulphonate. This method of operation is disadvantageous in that, inter alia, the oxide coatings obtained turn yellow under the influence of light. Finally, methods have also been described in which the formation of sealing layers is prevented by hot water sealing with the addition of specific polyacrylates or specific dextrins. These methods have proved to be satisfactory. However, drying residues can remain behind in many cases, particularly when the method is not carried out carefully. These residues are undesirable but they can be readily removed by after-rinsing.

It has also been proposed to use small quantities of hydroxycarboxylic acids, such as citric acid, tartaric acid, gallic acid and various phosphonic acids for the purpose of preventing the formation of sealing layers. However, when these substances are used, it has transpired that difficulties can arise with the over-metering of the effective substance, particularly in large baths which are badly circulated. Thus, it is not always a simple matter to adhere to the range of concentrations in which, on the one hand, the sealing layer is absolutely and reliably prevented and, on the other hand, the result of the short-time tests are not negatively influenced.

OBJECTS OF THE INVENTION

An object of the present invention, therefore, is to develop a method which represents a considerable improvement in the treatment of aluminum and aluminum alloy surfaces.

Another object of the invention is the development of a method for sealing surfaces of aluminum or aluminum alloys after anodic oxidation of said surfaces, which prevents the formation of a sealing layer without impairing the anodic oxide coating, reducing the quality of the seal, or adversely affecting the appearance of the surface.

A further object of the invention is the development of a method for sealing surfaces of aluminum or aluminum alloys after anodic oxidation of said surfaces by means of an aqueous solution containing extremely small amounts of certain cycloaliphatic or aromatic polycarboxylic acid additives, the nature of which additives greatly reduces the risk of their unintentional, detrimental oversupply in the treatment solutions.

A yet further object of the invention is the development of a method for sealing surfaces of aluminum or aluminum alloys after anodic oxidation of said surfaces,- which does not interfere with the effects imparted by the pre-treatment and anodization of said surfaces and which does not require any rinse or spray after sealing in order to remove any residues from the sealed surface.

A still further object of the invention is the development in the process of treating a surface of aluminum or an aluminum alloy which comprises anodically oxidizing and subsequently sealing the surface, the improvement consisting of sealing the surface in an aqueous solution at a temperature between 90° C. and the boiling temperature of the solution, said aqueous solution having a pH value of from 4 to 8 and containing from 0.0005 to 0.2 gm per liter of a cycloaliphatic or aromatic polycarboxylic acid or water-soluble salt thereof, said cycloaliphatic or aromatic polycarboxylic acid having 4 to 6 carboxyl groups in the molecule and optionally containing heteroatoms in the ring.

These and other objects of the invention will become more apparent as the description thereof proceeds.

DESCRIPTION OF THE INVENTION

The present invention relates to a method of treating the surfaces of aluminum or aluminum alloys by the anodic production of oxide coatings with subsequent sealing in aqueous solutions at elevated temperatures, said aqueous solutions containing cycloaliphatic or aromatic polycarboxylic acids or water-soluble salts thereof.

In particular the present invention involves, in the process of treating surfaces of aluminum or aluminum alloys which comprises anodic oxidation and subsequent sealing of the surface, the improvement consisting of sealing the surface in an aqueous solution at a temperature between 90° C. and the boiling temperature of the solution, said aqueous solution having a pH value of from 4 to 8, preferably 5 to 6, and containing from 0.0005 to 0.2 gm per liter of an additive selected from the group consisting of a cycloaliphatic polycarboxylic acid, an aromatic polycarboxylic acid, a water-soluble salt of said polycarboxylic acids, and mixtures thereof, said cycloaliphatic or aromatic polycarboxylic acid having 4 to 6 carboxyl groups in the molecule and optionally containing a heteroatom or heteroatoms in the ring.

The cycloaliphatic polycarboxylic acids for use in the process of the invention are preferably cycloalkanepolycarboxylic acids, especially cycloalkanepolycarboxylic acids having 5 to 8, more especially 5 or 6, carbon atoms in the ring. Cyclohexanepolycarboxylic acids have been found to be particularly useful. The aromatic polycarboxylic acids are preferably benzene polycarboxylic acids. One or more heteroatoms, such as oxygen, sulfur or nitrogen, can be located along the chain of the ring of the polycarboxylic acids used in the invention. Particularly advantageous among these heteroatom containing polycarboxylic acids are those having one such heteroatom, like tetrahydrofuran-2,3,4,5-tetracarboxylic acid.

Examples of polycarboxylic acids of the invention are benzene pentacarboxylic acid, benzene tetracarboxylic acid, benzene hexacarboxylic acid, cyclohexanetetracarboxylic acid, cyclohexanepentacarboxylic acid, naphthalene tetracarboxylic acid, cyclohexanehexacarboxylic acid, cyclopentanetetracarboxylic acid, and tetrahydrofuran tetracarboxylic acid.

Particularly useful are the benzene and cyclohexane polycarboxylic acids, viz benzene pentacarboxylic acid, benzene tetracarboxylic acid, benzene hexacarboxylic acid, cyclohexanetetracarboxylic acid, cyclohexanepentacarboxylic acid and cyclohexanehexacarboxylic acid. The polycarboxylic acids used can, however, also have heteroatoms in the ring. Instead of using the commercially available acids, the water-soluble salts thereof, such as the corresponding alkali metal, ammonium, alkaline earth metal, and alkanolamine salts can also be used for carrying out the method. The polycarboxylic acids can be present in the form of their partial salts. Thus, for example, the sealing solutions of the invention can contain cyclohexanehexacarboxylic acid in which 1 to 6 of the carboxyl groups have been neutralized. The polycarboxylic additives are used in amounts of from 0.0005 to 0.2 gm per liter, calculated as free acids, in the sealing solutions of the invention.

A preferred embodiment of the method of the invention resides in performing the sealing operation in solutions which contain a quantity of from 0.0005 to 0.2 gm per liter of benzene hexacarboxylic acid or of water-soluble salts thereof.

A further embodiment of the method resides in performing the sealing operation in solutions which contain a quantity of from 0.0005 to 0.2 gm per liter of cyclohexanehexacarboxylic acid or of water-soluble salts thereof.

Of the various isomeric forms of cyclohexanehexacarboxylic acid for use in the process of the invention, those which are particularly preferred are those having 5 cis-position and 1 trans-position carboxyl groups and those having 4 cis-position and 2 trans-position carboxyl groups, or water-soluble salts thereof.

The polycarboxylic acids of the invention can be prepared by known methods. The various isomeric forms of the cyclohexanehexacarboxylic acids, for example, are produced by known methods such as hydrogenation of mellitic acid with sodium amalgam or oxidation of bicyclo (2,2,2) oct -7-en-2,3,5,6-tetracarboxylic acid with nitric acid in the presence of oxidation catalysts. Specific isomeric forms of cyclohexanehexacarboxylic acid can also be obtained by dehydrating the cyclohexanehexacarboxylic acid at temperatures between 80° and 300° C. and subsequently hydrolyzing the dianhydride obtained.

The sealing solutions of the acids or salts in accordance with the present invention are adjusted to a pH value of 4 to 8, preferably 5 to 6. This adjustment may be conveniently effected with ammonia or acetic acid. It is advantageous to use fully desalinated water, distilled water, or water of condensation for the purpose of preparing the sealing solutions of the invention.

The sealing operation is performed with the solutions in accordance with the present invention at temperatures between 90° C. and the boiling temperature of the sealing solution. In general, a temperature of 98° to 100° C. is maintained. Treatment with the sealing solutions is carried out for a time sufficient to produce a good seal. The sealing time lies within the conventional range for sealing aluminum or aluminum alloy surfaces and is approximately 1.5 to 3.5 min. per $\mu$m thickness of the anodic oxide coating.

Furthermore, conventional additives known for these purposes, such as nickel or cobalt acetate, can be added to the sealing solutions in small quantities of from 0.0001 to 0.5 gm per liter.

The novel sealing method of the invention makes it possible to prevent the formation of sealing layers on anodically oxidized aluminum or aluminum alloy surfaces without impairing the anodic oxide coating or reducing the quality of the seal. The risk of unintentional, detrimental over-metering of additives is greatly reduced because of the special properties of the effective polycarboxylic compounds used. There is no need to rinse or spray after sealing in order to remove any residues from the surface. The appearance of the surface is not affected by the method in accordance with the present invention and the effects obtained by pretreatment and anodization are maintained. A further advantage of the invention is that the quantities of polycarboxylic additives needed in the sealing process are extremely small.

The following examples are illustrative of the practice of the invention without being limitative in any manner.

EXAMPLES

In the following Examples, the aluminum alloys are designated in accordance with DIN 1 7125. The quality of the oxide coatings was determined by the admittance or *y* value in accordance with DIN 50 949 and by the loss factor *d* in accordance with DIN 50 920. Furthermore, the quality of the sealing was tested by the acetic acid/acetate test (ISO R 2932).

EXAMPLE 1

Aluminum sheets (AlMg 1) which had been alkaline degreased and pickled in a conventional manner and anodically oxidized by the direct current/sulphuric acid method (coating thickness 20 μm.), were sealed at 100° C. for 60 minutes in a solution of 0.01 gm/l cyclohexanehexacarboxylic acid (isomer with 5 cis-position and 1 trans-position carboxyl groups) in fully desalinated water, the solution having been adjusted to pH 5.7 with ammonia. The sheets did not exhibit any sealing layer. The thickness of the coating was 20 μm after sealing. The admittance had dropped from more than 400 to 13.5 μS. The loss factor was 0.5. A loss of weight of 8.1 mg/dm$^2$ was found in the acetic acid/acetate test.

Virtually the same results were obtained after corresponding pH adjustment with acetic acid or ammonia when the cyclohexanehexacarboxylic acid was replaced by an equivalent quantity of its sodium, potassium, ammonium, magnesium, calcium, or alkanolamine salts in which 1 to 6 carboxyl groups had been neutralized.

EXAMPLE 2

In a large sealing bath having a capacity of approximately 24 m$^3$, degreased and pickled aluminum profiles, made from the alloy AlMgSi 0.5 and anodized by the direct current/sulphuric acid method (coating thickness 18 μm), were sealed for 55 minutes at 98° C. without air injection or circulation, in a solution of 0.02 gm/l cyclohexanehexacarboxylic acid (calculated from the pentasodium salt of the isomer having 5 cis-position and 1 trans-position carboxyl groups), which had been adjusted to pH 5.9 with acetic acid. The samples did not exhibit any sealing layer. The admittance had dropped from more than 400 to 14 μS. The loss factor was 0.46. A loss of weight of 12.5 mg/dm$^2$ was found in the acetic acid/acetate test.

EXAMPLE 3

Aluminum profiles, which had been made from the alloy AlMgSi 0.5, degreased and pickled in a conventional manner, and anodically oxidized by the direct current/sulphuric acid and oxalic acid method (coating thickness 20 μm), were sealed for 60 minutes at 100° C. in a solution of 0.001 gm/l cyclohexanehexacarboxylic acid (isomer with 5 cis-position and 1 trans-position carboxyl groups) in fully desalinated water, the pH value of the solution having been adjusted to 5.7 with ammonia. The profiles did not exhibit any sealing layer. The *y* value had dropped from more than 400 to 13.5 μS. The *d* value was 0.45. A loss of weight of 3 mg/dm$^2$ was found in the acetic acid/acetate test.

EXAMPLE 4

Profiles made from the alloy AlMgSi 0.5, which had been degreased and pickled by the conventional method and anodically oxidized by the direct current/sulphuric acid method (coating thickness 20 μm), were sealed for 60 minutes at 100° C. in a solution of 0.1 gm/l benzenehexacarboxylic acid in deionized water, the pH value of the solution having been adjusted to 5.8 with ammonia. The samples did not exhibit any sealing layer. The admittance had dropped from more than 400 to 14 μS. The loss factor was 0.5. A loss of weight of 16.8 mg/dm$^2$ was found in the acetic acid/acetate test.

Virtually the same results were obtained after corresponding pH adjustment with acetic acid or ammonia when the benzene hexacarboxylic acid was replaced by an equivalent quantity of its sodium, potassium, ammonium, magnesium, calcium or alkanolamine salts in which 1 to 6 carboxyl groups had been neutralized.

EXAMPLE 5

Alkaline degreased and pickled aluminum profiles (AlMgSi 0.5), which had been anodically oxidized by the direct current/sulphuric acid method (coating thickness 18 to 20 μm), were sealed for 60 minutes at 100° C. at a pH value of 5.6 (adjusted with ammonia) in solutions which contained the concentrations of the additives given in the following Table. The prevention of the formation of a sealing layer and the influence of the additives on the sealing quality, measured with the reference to the admittance, the loss factor and the loss of weight in the acetic acid/acetate test, are given in the following Table. No sealing layer is formed and the sealing quality is not impaired when the other compounds of the present invention are used in corresponding concentrations in place of the compounds in the following Table.

TABLE

| Additive | Concentration (gm/l) | Sealing Layer | Admittance (μS) | Loss Factor | Loss of Weight in acetic acid/acetate test (mg/dm$^2$) |
|---|---|---|---|---|---|
| Benzene Hexa- | 0.01 | Prevented | 13.9 | 0.51 | 1 |
| carboxylic acid | 0.02 | Prevented | 13.7 | 0.51 | 1.5 |
| Cyclohexanehexa- | 0.02 | Prevented | 14.0 | 0.5 | 12.3 |
| carboxylic acid | 0.03 | Prevented | 13.5 | 0.53 | 16.4 |
| (5 cis, 1 trans) | | | | | |
| Cyclohexanehexa- | 0.01 | Prevented | 13.0 | 0.52 | 8.7 |
| carboxylic acid | 0.03 | Prevented | 13.5 | 0.51 | 15.8 |
| (cis,cis,trans, cis,cis,trans) | | | | | |
| Cyclohexanehexa- | 0.01 | Prevented | 13.5 | 0.53 | 14.3 |
| carboxylic acid (6 cis) | | | | | |
| Cyclohexanehexa- | 0.01 | Prevented | 13.5 | 0.45 | 10.2 |
| carboxylic acid (cis,trans,cis, trans,cis,trans) | | | | | |
| Cyclohexane- | 0.01 | Prevented | 13.5 | 0.45 | 14.3 |
| tetracarboxylic acid | | | | | |
| Citric Acid | 0.01 | Prevented | 12.5 | 0.45 | 20.3 |

TABLE-continued

| Additive | Concentration (gm/l) | Sealing Layer | Admittance (μS) | Loss Factor | Loss of Weight in acetic acid/acetate test (mg/dm$^2$) |
|---|---|---|---|---|---|
| (comparison test) | 0.02 | Prevented | 13.0 | 0.45 | 29.2 |

The preceding specific embodiments are illustrative of the practice of the invention. It is to be understood, however, that other expedients known to those skilled in the art, or disclosed herein, may be employed without departing from the spirit of the invention or the scope of the appended claims.

We claim:

1. In the process of treating surfaces of aluminum or aluminum alloys which comprises anodic oxidation and subsequent sealing of the surface, the improvement consisting of sealing the surface in an aqueous solution at a temperature between 90° C. and the boiling temperature of the solution, said aqueous solution having a pH value of from 4 to 8, and containing from 0.0005 to 0.2 gm per liter of an additive selected from the group consisting of a cycloaliphatic polycarboxylic acid, an aromatic polycarboxylic acid, a water-soluble salt of said polycarboxylic acids, and mixtures thereof, said cycloaliphatic or aromatic polycarboxylic acid having 4 to 6 carboxyl groups in the molecule and optionally containing a heteroatom or heteroatoms in the ring.

2. The method of claim 1, wherein the aqueous solution has a pH value of 5 to 6.

3. The method of claim 1, wherein the additive is a benzene polycarboxylic acid or a water-soluble salt thereof.

4. The method of claim 3, wherein the additive is benzene hexacarboxylic acid or a water-soluble salt thereof.

5. The method of claim 1, wherein the additive is a cycloalkanepolycarboxylic acid having 5 to 8 carbon atoms in the ring.

6. The method of claim 5, wherein the additive is a cyclohexanehexacarboxylic acid or a water-soluble salt thereof.

7. The method of claim 6, wherein the additive is a member selected from the group consisting of cyclohexanehexacarboxylic acid having 5 cis-position and 1 trans-position carboxyl groups, cyclohexanehexacarboxylic acid having 4 cis-position and 2 trans-position carboxyl groups, and a water-soluble salt thereof.

8. The method of claim 1 wherein the additive is a member selected from the group consisting of benezene pentacarboxylic acid, benzene tetracarboxylic acid, benzene hexacarboxylic acid, cyclohexanetetracarboxylic acid, cyclohexanepentacarboxylic acid, cyclohexanehexacarboxylic acid, and water soluble salts of said polycarboxylic acids.

9. The method of claim 1 wherein the water of the sealing solution is a member selected from the group consisting of fully desalinated water, distilled water and water of condensation.

10. The method of claim 1 wherein the additive is a member selected from the group consisting of cyclohexanehexacarboxylic acid having 5 cis-position and 1 trans-position carboxyl groups, benzene hexacarboxylic acid, cyclohexanehexacarboxylic acid having 4 cis-position and 2 trans-position carboxyl groups, cyclohexanehexacarboxylic acid having 6 cis-position carboxyl groups, cyclohexanehexacarboxylic acid having 3 cis-position and 3 trans-position carboxyl groups, cyclohexanetetracarboxylic acid, and water-soluble salts thereof.

11. The method of claim 1, wherein the aqueous solution additionally contains from 0.0001 to 0.5 gm per liter of nickel or cobalt acetate.

* * * * *